US006176766B1

(12) United States Patent
Silverman

(10) Patent No.: US 6,176,766 B1
(45) Date of Patent: Jan. 23, 2001

(54) CENTERLESS GRINDING FIXTURE

(76) Inventor: Emanuel Silverman, 14401 Hartsook, Sherman Oaks, CA (US) 91423

( * ) Notice: Under 35 U.S.C. 154(b), the term of this patent shall be extended for 0 days.

(21) Appl. No.: 09/179,067

(22) Filed: Oct. 26, 1998

(51) Int. Cl.[7] ..... B24B 5/18
(52) U.S. Cl. ..... 451/243; 451/242
(58) Field of Search ..... 451/242, 243

(56) References Cited

U.S. PATENT DOCUMENTS 2,770,081 * 11/1956 Northcutt et al. ..... 451/243 X
5,569,059 * 10/1996 Kirt ..... 451/243 X
5,573,451 * 11/1996 Tschudin ..... 451/243

* cited by examiner

*Primary Examiner*—Timothy V. Eley

(57) ABSTRACT

A centerless grinding fixture for grinding multi-diamtter forms that do not lend themselves to be ground on a conventional centerless grinder. An example of such a part will be shown in which all surfaces,including the sides,may be ground without removing the workpiece from the grinding fixture.

6 Claims, 4 Drawing Sheets

CENTERLESS GRINDING FIXTURE

This invention relates to a fixture for a centerless grinding machine and more particularly to a fixture for a centerless grinding machine capable of a rapid high precision placement of work on the machine.

FEDERALLY SPONSORED RESEARCH

No part of this patent application was developed with the aid of any federally sponsored research and development.

BACKGROUND AND RELATED ART

Centerless grinding machines are well known in the art. Typically they include a grinding wheel and a regulating wheel for controlling the rate that the work is fed through the machine. However setting up the work on the machine is time consuming when high precision work is required. Heretofore, when the job was completed, the machine settings for that work were lost when the work was removed from the grinder. Then if an another order for what work was received, the grinding machine had to be reset, which was expensive.

To overcome this problem, a fixture for a centerless grinder has been designed so that the machine settings are not lost when the work is removed. In this way, when an additional order for that work is received, the machine does not have to be reset.

To do this a regulating wheel assembly for each job is designed so it is independent of the grinding machine and can be removed and stored as a unit without disturbing the grinding machine settings. This leaves the main shaft free to accept other combinations of regulating wheels for grinding differently shaped forms. Then if additional orders for that work are received, the regulating wheel assembly for that job is simply replaced on the grinding machine, and the machine is ready for work.

What is needed therefore and comprises an important object of this invention is to provided a fixture for a centerless grinding machine which is designed so the regulating wheel assembly can be quickly and easily removed from the fixture without disturbing the machine settings.

Yet another object of this invention is to provide a centerless grinding machine where the regulating wheel assembly is independent of the grinding machine.

Another object of this invention is to provide a centerless grinding machine that is designed so the regulating wheel assembly can be quickly removed and replaced on the grinding machine.

These and other objects of this invention will become more apparent when better understood in the light of the accompanying drawings and specification wherein:

DETAILED DESCRIPTION

Figures 1, 2:
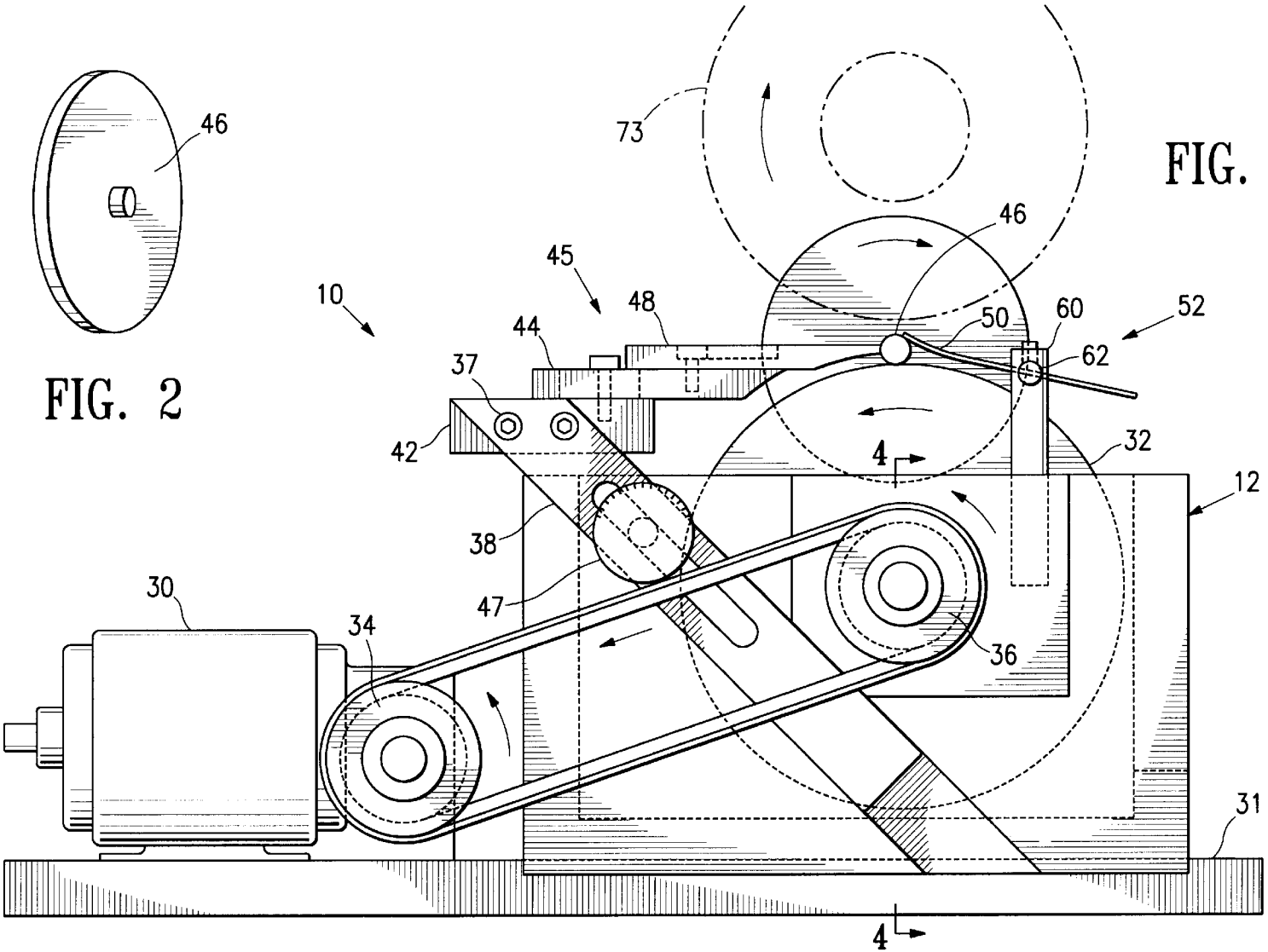
FIG. 1 is a side elevational view of the grinding fixture with a workpiece in position.
FIG. 2 is a perspective view of a typical work piece mounted on the fixture.

Referring now to FIG. 1 of the drawing, the centerless grinding fixture 10 comprises a base or casting 20 which is mounted on a pair of sine bars 25. As will become apparent below, the sine bars provide a means for precisely grinding the surface of the work piece to any angle with the use of Jo blocks placed under either bar.

Figure 4:
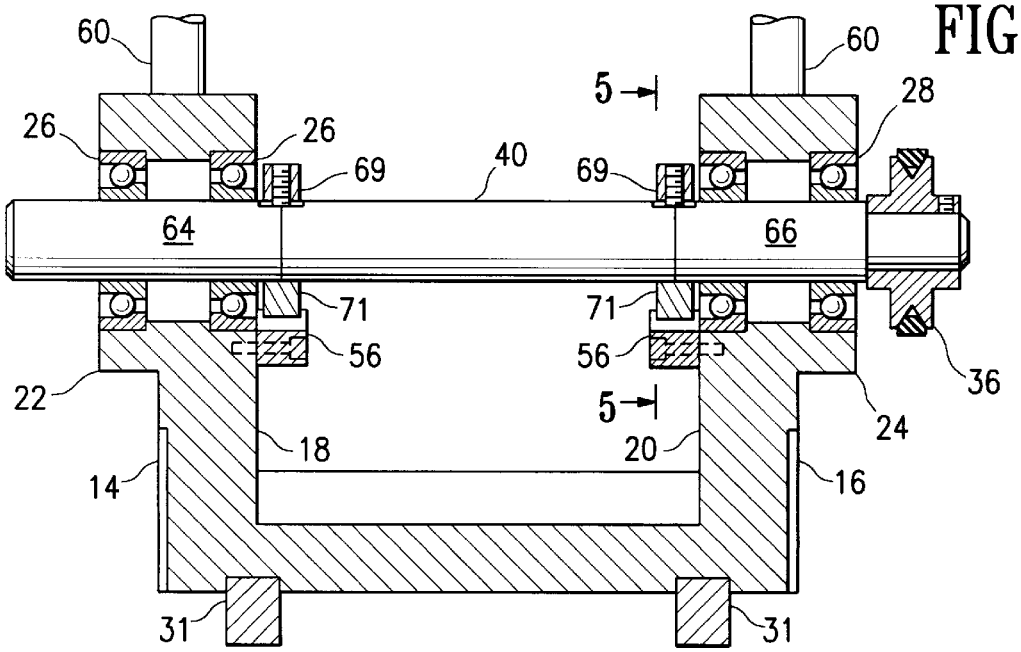
FIG. 4 is a partial sectional view taken on the line 4—4 of FIG. 1 FIG. 4 showing a cross sectional view of the facing parallel side walls of the base and showing bearings mounted in the side wall hubs

The casting 20 is generally U-shaped with upstanding side walls 21 and 22, see FIG. 4. The facing surfaces of 21*a* and 22*a* of the walls are in a common plane, however, as shown the surfaces of the walls opposite the facing surfaces are offset to form bearing containing hubs 47 and 49. Cylindrical holes are formed in each hub in axial alignment with each other and with precision bearings 46 and 48 mounted in each hole.

An electric motor 16 is mounted on the casting 20 to drive the regulating wheel assembly 34 through pulleys 17 and 19, see FIG. 1. Support or side arms 84 on both sides of the base are connected by screws 86 to a support plate or platform 82. A platform 82*a* mounted on platform 82 supports guide assembly 26 which positions the workpiece 12 on the regulating wheel assembly 34, see FIG. 1.

The 45 degree support arms 84 are adjustable and slotted to keep the platform 82 at the required angle to the casting 20 during adjustment. This movement is controlled by the indicating wheel 96 which is connected to a rack and pinion (not shown). This positions the work piece 14 on the support plate 82 so it properly engages the regulating wheel assembly 34.

Figure 3:
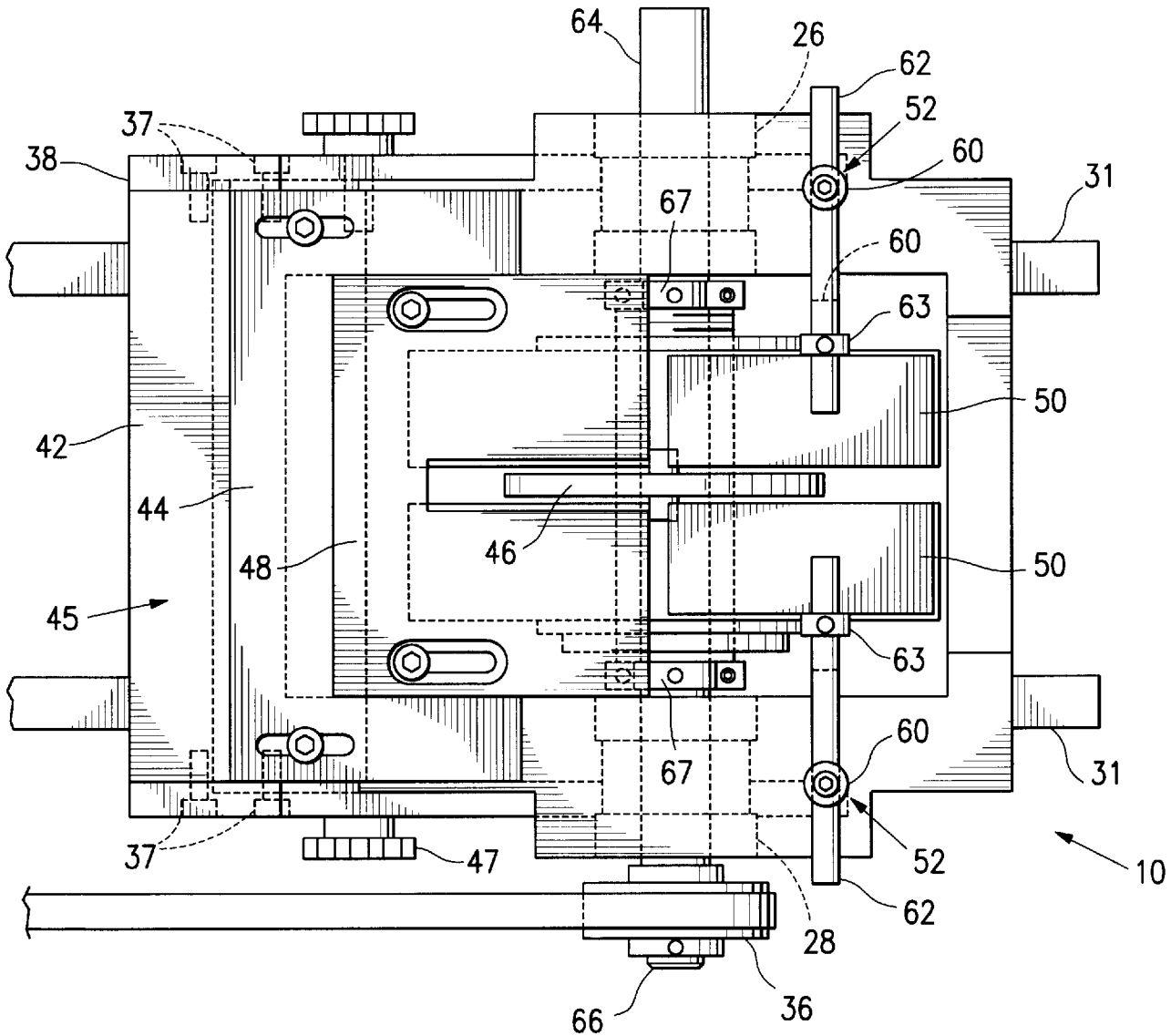
FIG. 3 is a top view of the grinding fixture.
Figure 7:
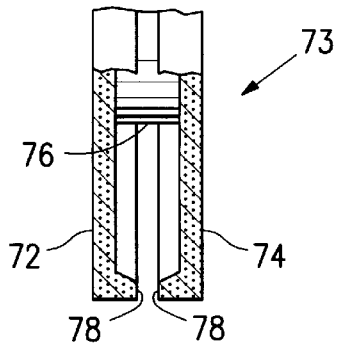
FIG. 7 is an elevational view of the retaining washer taken on the line 7—7 of FIG. 6.

The workpiece 14 is held in place by a flat spring 66 that presses against the circumference of the regulating wheel assembly 34. The spring 66 is held by a spring assembly comprising a post 60, which may be adjustable in height. This post positions a rod 62 inside the post in the horizontal plane so the spring can be rotated. The spring 66 is mounted in the slots formed in the rod 62 so it can be adjusted and are locked therein in a manner well known in the art, see FIG. 3.

Referring again to FIG. 4. it will be noted that the precision bearings 46 and 48 are mounted in the cylindrical openings in the hubs in such a WY that their centers define a centerline. Shafts 30 and 32 are inserted along the centerline through bearings 46 and 48. In this way the axes of the drive shafts will be aligned with each other. As will be described below, a support shaft 40 for the regulating wheel assembly is connected to the facing ends of the shafts in such a way that its axis and will be aligned with the axes of the shafts 30 and 32, see FIG. 4.

The drive pulley 19 shown in FIG. 1 is connected to the shaft 30. The shaft 32 may be extended to support other regulating wheels and castings, (not shown) in accordance with the requirements of the work.

As shown in FIG. 1, the guide blade 76 is adjustably mounted on the guide assembly 26 by means of bolts 78 that extend through the slots . In operation, the front edge of the guide blade 76 engages and positions the workpiece 14 with respect to the regulating wheel assembly 34. For in through feeding, the blade 12 is set at an angle to the regulating wheel assembly which induces the workpiece to move forward under the grinding wheel.

As shown in FIG. 1 the casting 20 is attached to the side arms 9 which ride in channels machined at a 45-degree angle to the base plate. In this way, movement of the guide assembly 26, maintains the angle at which the working end of blade 76 engages the workpiece 14.

Figure 6:
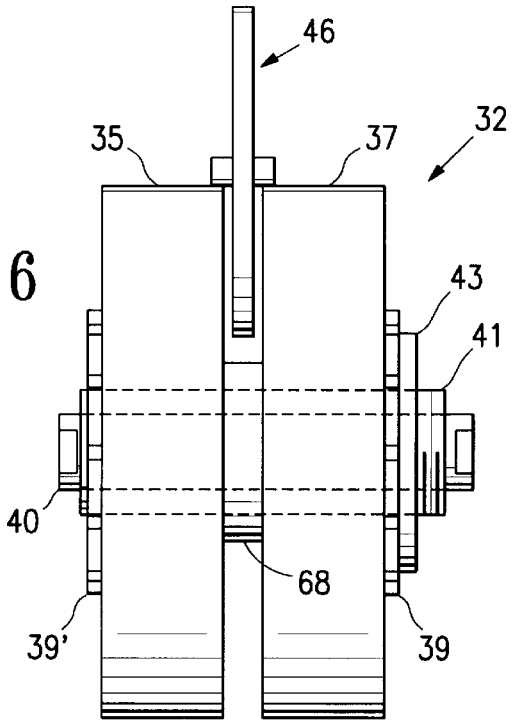
FIG. 6 is an elevational view of the regulating wheel assembly showing the workpiece in position on the regulating wheel assembly.
Figure 5:
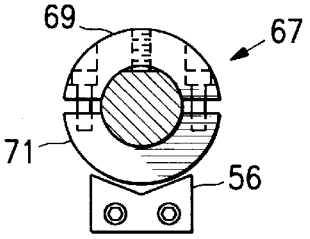
FIG. 5 is a partial sectional view taken on the line 5—5 of FIG. 4 FIG. 3 showing in cross section of one of a pair of the clamps that tie the main shaft of the regulating wheel to the drive shafts mounted in the base or casting of the fixture.

As seen in FIG. 6 the regulating wheel assembly 34, in this particular embodiment, is composed in two sections 35 and 37. These sections are mounted on a tubular secondary shaft 38 see FIG. 6. The secondary shaft 33 is concentric with the closely fitting support shaft 40. Shaft 40 is connected to and driven by drive shafts 30 and 32 by means of semi-circular clamps 50, see FIGS. 4 and 5.

To hold the regulating assembly together, the shaft or tube 38 is threaded at its opposite ends. Threaded washers 42 are threaded at each end of tube 38 bearing against regulating wheel section 34 to hold the regulating wheel sections together. A threaded washer 44 is also threaded on one end of tube 33 bearing against washer 42. These washers may be provided with notches (not shown) so they may be conveniently adjusted with a spanner wrench. In this way, when the washer 44 is tightened, the regulating wheel assembly is attached to the support shaft 40, see FIG. 6.

The regulating wheel sections 34 and 35 are separated on support shaft 40 by a spacer 36 whose size is determined by the requirements of the workpiece, see FIG. 6. Positioning blocks 58 are secured to the facing surfaces 21*a* and 22*a* of casting 20 and are positioned by any suitable means so they extend toward each other an equal distance from the facing surfaces of the side walls. The lower halves 54 of the semi-circular support clamps 50 rest on positioning blocks 58 and are secured thereto by any suitable means, see FIG. 4.

To attach the regulating wheel assembly 34 to the casting 20, the support shaft 40 with the regulating wheel sections 35 and 37 are lowered between the side walls 21 and 22 of the casting until the opposite ends of the support shaft 40 rests on the lower ends 54 of the semicircular support clamps 50, see FIG. 4. In this position, the drive shafts 30 and 32 and support shaft 40 is aligned with each other. With this arrangement, when the lower ends or halves 54 of the clamps 50 are tied to the upper end 52 of the clamps 50 by means of screws 53, the regulating wheel assembly is tied both to the support shaft 40 and the shafts 30 and 32. Sufficient clearance between the clamps 50 on the sides of the casting, and the support or positioning blocks 58 allow free rotation of the shaft 32 and the regulating wheel assembly. In this way when the motor drives the drive shaft 40, the regulating wheel assembly rotates.

As seen in FIG. 4, when the lower end 54 of clamps 50 are disconnected from the upper end 52 of the clamps, the entire regulating wheel 34 and its supporting shaft 40 may be lifted out of the casting 20 and removed and stored for future use when grinding the same workpiece.

In operation, to attach the regulating wheel assembly to the base or casting 20, it is simply lowered between the spaced walls 21 and 22 until the opposed ends of the support shaft 40 engage and are supported by the fixed semi-circular portions 54 of the clamps 50. These supports extend toward each other with one half of the width of each semi-circular support on each section of the support shaft 40. In this way when the upper ends or halves 52 of the semi-circular clamps are positioned around the shaft 32 and are securely bolted to the lower ends 54 by any suitable means, the shafts 30 and 32 and support shaft 40 will be in axial alignment and tied to each other.

It is noted that the regulating wheel is consructed for a particular work piece, and when grinding the job is done, the semi-circular upper ends 52 of the clamps 50 are separated from the semi-circular lower ends 54, and the entire regulating wheel assembly is simply lifted off the casting 20 and stored away for future use. Later when there is an order for additional work pieces for which the regulating wheel was designed, the entire regulating wheel assembly is simply placed on semi-circular lower end 54 of clamps 50, and the semi-circular upper ends 52 of the clamps 50 are clamped to the lower end 54 and the centerless grinder is ready for operation. This operation does not affect the bearings 46 and 48, on the support so that the tolerances of the grinding machine are not affected.

Figure 8:
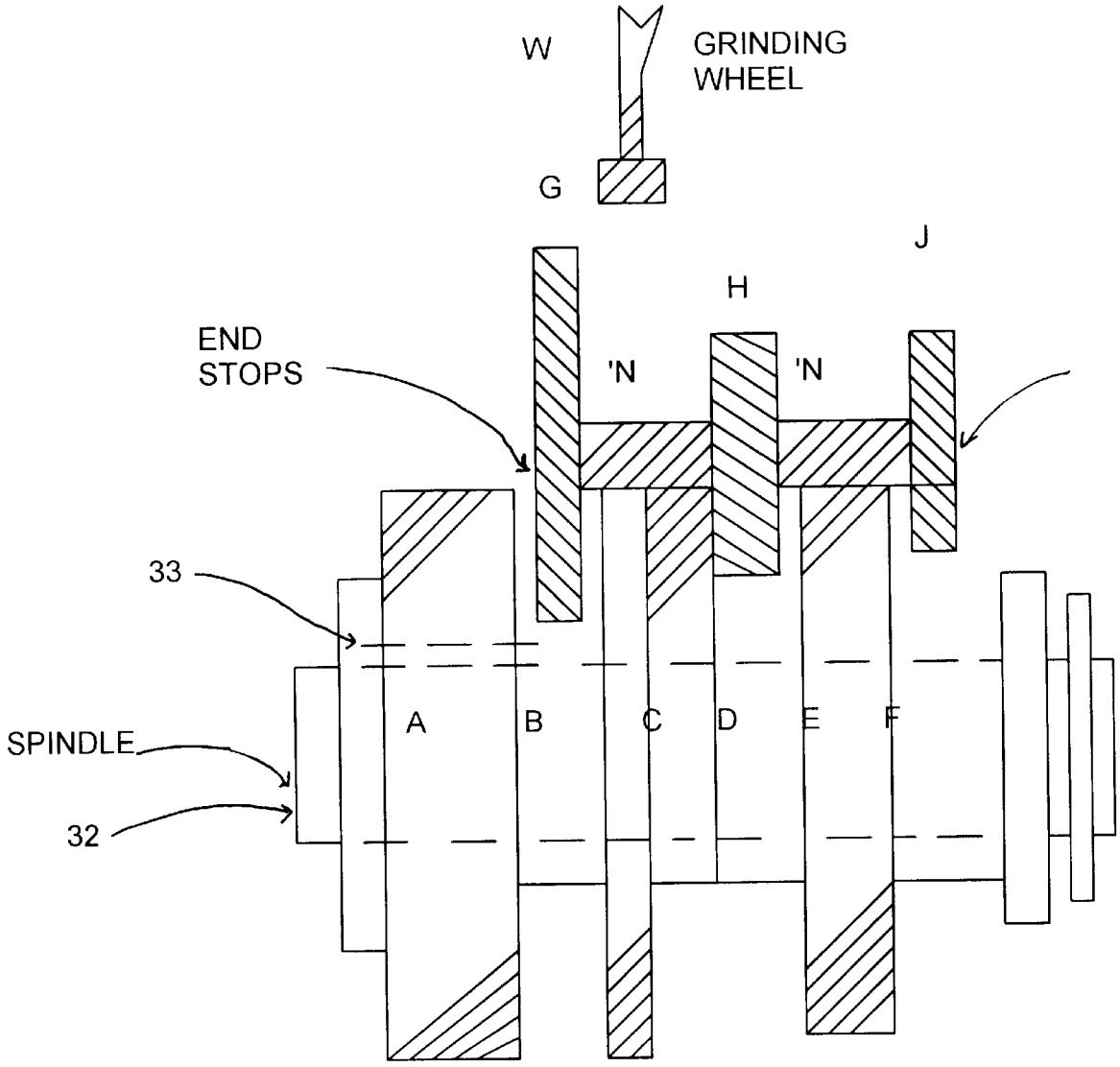
FIG. 8 is a partial sectional view of a grinding wheel assembly designed to grind multiple surfaces on the workpiece.

The spacing between regulating wheel sections 35 and 37 permit a grinding wheel to be designed so that more than one surface of the work can be ground with a single pass of the grinding wheel. As shown in FIG. 8, the grinding assembly 5 is formed from two sections 7 and 9. These sections are held apart by a spacer 11 which is also a grinding surface. Tbe facing peripheral edges 13 of the sections 7 and 9 are also grinding surfaces.

With this arrangement, the grinding wheel assembly can be lowered onto the workpiece 12 to grind the opposed surfaces 13 of the large diameter part of the work piece 14 and the grinding surface 11 will at the same time grind the planar surface of the small diameter part of the workpiece, see FIG. 2.

The regulating wheel 34 shown in FIG. 6 is formed in two sections, but depending on the demands of the work, the regulating wheel can be formed with multiple sections. But in any event the regulating wheel would be attached to the casting the same way as with the two section regulating wheel shown in FIG. 4.

What is claimed is:

1. A fixture for a centerless grinding machine comprising a base, a regulating wheel assembly for a particular piece of work mounted on said base, said regulating wheel assembly formed from at least two sections secured together in spaced relationship to each other, a support shaft, said sections of the regulating wheel assembly removably mounted on said support shaft, aligned drive shafts mounted on said base, means for removably attaching said support shaft to said drive shafts so the drive shafts and support shafts are in linear alignment whereby the entire regulating assembly can be lifted off the base and stored for future use.

2. The grinding machine described in claim 1 wherein said base having means connected to said drive shafts for driving them and the regulating wheel assembly when the drive shafts are connected to the support shaft.

3. A fixture for a centerless grinding machine comprising a casting, said casting having upstanding side walls, said side walls having facing surfaces, oppositely extending hubs formed in the side walls, sets of bearings mounted in the hubs in such a way that the center line of the bearings in the side walls are in alignment, drive shafts mounted in each side wall with the axes of each drive shaft aligned with the center line of the bearings, positioning supports mounted on the facing surfaces of each side wall, support clamps fixedly mounted each side wall and positioned by said positioning supports, a support shaft for a regulating wheel, clamping means for each end of the support shaft for releasably clamping the support shaft on the shaft supports to the drive shafts so that the axis of the support shaft is in alignment with the axes of the drive shafts.

4. The fixture for a centerless grinding machine as described in claim 3 including a motor mounted on said casting, said motor connected to said drive shafts to drive them, means on said casting for resiliently holding a workpiece against a grinding wheel.

5. In a centerless grinding machine, a casting, said casting having upstanding side walls, a bearing support hub on each side wall, sets of bearings for supporting drive shafts mounted in said hubs in such a way that the center line of the bearings in the side walls are in alignment, drive shafts mounted in said hubs and supported by said bearings with the axes of each drive shaft aligned with the center line of the bearings, positioning supports mounted on the facing surfaces of each side wall, shaft supports fixedly mounted each side wall and positioned by said positioning supports, a support shaft for a regulating wheel, clamping means for each end of the support shaft for releasably clamping the support shaft on the shaft supports to the drive shafts so that the axis of the support shaft is in alignment with the drive shafts.

6. A fixture for a centerless grinding machine comprising a casting, said casting having upstanding side walls, said side walls having facing surfaces, a bearing supporting hub on each side wall, sets of bearings for supporting drive shafts mounted in said hubs in such a way that the center line of the bearings in the side walls are in alignment, drive shafts mounted in said hubs supported by said bearings with the axes of each drive shaft aligned with the center line of the bearings, positioning supports mounted on the facing surfaces of each side wall, clamping means fixedly mounted each side wall and positioned by said positioning supports, a regulating wheel assembly ,a support shaft for said regulating wheel assembly, clamping means for each end of the support shaft for releasably clamping the support shaft on the shaft supports to the drive shafts so that the axis of the support shaft is in alignment with the drive shafts, said regulating wheel assembly having two sections spaced apart by means of a spacer, a secondary tube threaded at each end concentric with and extending through said regulating wheel sections, threaded washers threaded onto the threaded portions of the secondary tube that extend through the regulating wheel sections so that when the washers are tightened, the regulating wheel sections are tied together, said support shaft removably positioned inside said secondary tube, an additional washer threaded onto the tube to lock the secondary tube to the support shaft.

* * * * *